United States Patent [19]

Boyer

[11] Patent Number: 4,898,311

[45] Date of Patent: Feb. 6, 1990

[54] BINOCULAR STABILIZER DEVICE

[76] Inventor: Robert Boyer, 216 Honeysuckle Ave., Paso Robles, Calif. 93446

[21] Appl. No.: 182,908

[22] Filed: Apr. 18, 1988

[51] Int. Cl.[4] ..... A45F 3/14; A44B 11/20; A44B 21/00

[52] U.S. Cl. ..... 224/257; 224/208; 224/908; 224/909; 24/3 C; 24/662

[58] Field of Search ..... 224/101, 254, 255, 257, 224/908, 909; 351/156, 157; 403/223; 24/3 C, 324, 662, 3 F, 31 U; 128/864–868

[56] References Cited

U.S. PATENT DOCUMENTS 3,326,430 6/1967 Banks ..... 224/909

4,420,859 12/1983 Hammerle ..... 24/585

4,541,696 9/1985 Winger et al. ..... 351/156

*Primary Examiner*—Henry J. Recla

*Assistant Examiner*—Robert Fetsuga

*Attorney, Agent, or Firm*—Jerry N. Lulejian

[57] ABSTRACT

In connection with a pair of binoculars hung over a hunter's neck, a device for keeping the binoculars secured to the user's body, including a length of surgical tubing with a gripping piece installed within the tubing on both ends. Each gripping piece has a hole in it for the attachment of a metal ring to be connected to the binoculars and to a quick release mechanism to aid in the installation of the invention around the torso of the hunter.

4 Claims, 1 Drawing Sheet

BINOCULAR STABILIZER DEVICE

BACKGROUND OF THE INVENTION

The present invention relates to a device for stabilizing an article worn around a user's neck and more specifically for a pair of hunter's binoculars.

The present invention is especially useful for hunters who carry many devices around their waist, shoulders and neck. The hunter may be able to stabilize the devices carried on both shoulders with his two hands, but will be forced to leave the device hung around his neck to bounce uncontrollably while the he is running. This uncontrolled bouncing of the binoculars is not only extremely uncomfortable for the hunter, but it may allow the binoculars to strike other equipment carried by the hunter or trees or bushes causing much noise and disturbance in the environment. Disturbances in the environment are the last thing a hunter wishes to do. Nevertheless, the hunter is forced to leave the binoculars slung about his neck so that he will have easy access to them at all times in search of prey. It is with this problem in mind that the present invention was created.

The present invention has solved this exasperating problem by supplying an elastic cable which is interconnected to the binoculars and installed around the torso of the hunter.

SUMMARY OF THE INVENTION

The present invention is a device to be used in connection with an article supported by the neck of its user and suspended about the user's body for keeping the article secured to the user's body. The device of the present invention comprises in its broadest sense an elastic cable and a means for interconnecting the elastic cable and the article. The elastic cable is installed around the user and interconnected to the article.

The elastic cable may comprise elastic tubing and the means for interconnecting the elastic cable and the article may comprise an elongated gripping piece having at least two ridges perpendicular to a longitudinal dimension of the gripping piece for gripping the elastic tubing when the gripping piece is installed within the elastic tubing. In addition, the device may have a means for securing the gripping piece to the article.

The elastic tubing is typically surgical tubing and the means for securing the gripping piece to the article is typically a wire ring placed through an area defining a hole in the gripping piece and an area defining a hole on the article.

DETAILED DESCRIPTION OF THE INVENTION

Figure 1:
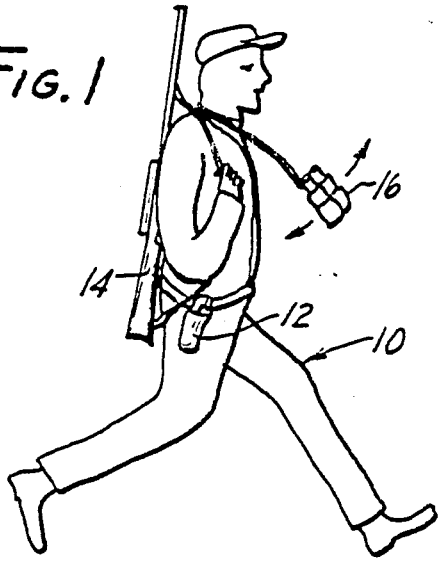
FIG. 1 is a side elevational view of a hunter in the running position with his binoculars swinging wildly around his neck.

Referring specifically to FIG. 1, a hunter 10 is seen in a running position with a gun in a holster 12, a rifle 14 slung over his right shoulder, and (unshown) a bow slung over his left shoulder. In addition, this hunter 10 has a pair of binoculars 16 hung over his neck. As can be seen in FIG. 1, the problem that hunters have faced wnen they are walking or running is that their binoculars will swing wildly about their torso. This problem is unavoidable because the hunter 10 does not have enough hands to secure his rifle 14, his bow and the b:noculars 16. The wild swinging and bouncing of the binoculars 16 is at best very uncomfortable for the hunter. In addition, the bouncing of the binoculars 16 may allow the binoculars 16 to strike other equipment carried by the hunter 10 or trees or bushes causing much noise and disturbance in the environment, which is the last thing that the hunter 10 wishes to do. Also, hunters have had a problem of catching their binoculars on bushes while they are hunched over stalking their prey. For that matter, hunters have had a problem bending over to take a drink from a stream since their binoculars will fall into the stream. Binoculars also cause neck fatigue when carried long distances. Nevertheless, the hunter 10 is forced to leave the binoculars 16 hung about his neck so that he will have easy access to them at all times in search of prey. It is with this problem in mind that the present invention was created.

Figure 2:
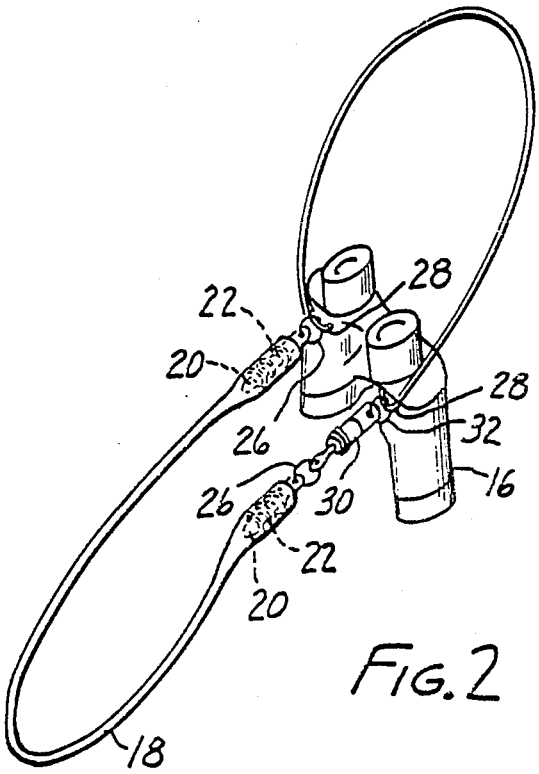
FIG. 2 is a perspective view of the present invention installed on a pair of binoculars.
Figure 4:
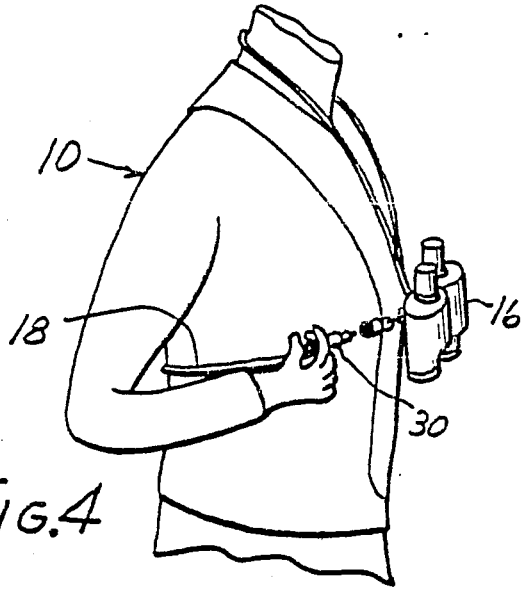
FIG. 4 is a perspective view of the torso of the hunter with the inventon installed around his torso.

Referring to FIGS. 2 and 4, the present invention has solved this exasperating problem by supplying an elastic cable 18 interconnected to the binoculars 16 and installed around the torso of the hunter 10. The elastic cable 18 is typically composed of surgical tubing having a diameter of 5/32 inch with 1/32 inch walls. Approximately two and one-half (2½') feet of this tubing will be sufficient for most hunters.

Figure 3:
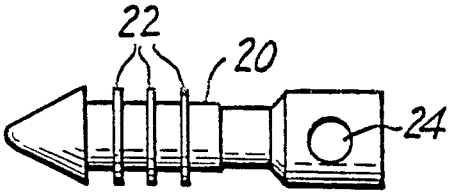
FIG. 3 is a side elevational view of the gripping piece of the present invention.

Referring specifically to FIGS. 2 and 3, the elastic cable 18 is preferably attached to the binoculars 16 via a gripping piece 20 which has three ridges 22 placed perpendicular to the longitudinal dimension of the gripping piece 20 to grip the inside of the elastic cable 18. Typically, the gripping piece 20 has a ¼ inch width across its ridges 22 and has a hole 24 therein for the placement of a wire ring 26 (FIG. 2), which can also be placed through the eyelets 28 of the binoculars 16. This would accomplish the interconnection of the elastic cable 18 with the binoculars 16.

The preferred embodiment of the present invention also contemplates a quick release mechanism 30 interposed between one of the gripping pieces 20 and the binoculars 16 by an extra wire ring 32. The wire ring 32 is preferably installed on an eyelet 28 on the binoculars 16. The quick release mechanism 30 can be any of a number of commercially available and commonly used for key rings. Such a quick release mechanism 30 is one manufactured by D. F. Kemp Co., 30739 La Brista Drive, Malibu, California or is model #7912 manufactured by Allison Corporation, Livingston, New Jersey.

Referring specifically to FIG. 4, the present invention is installed by having its quick release mechanism 30 disengaged and routing the elastic cable 18 around the torso of the hunter 10 while the binoculars 16 are suspended about the hunter's neck. The quick release mechanism 30 is then installed, and the binoculars 16 are secured to the hunter 10 even when the hunter 10 is running vigorously. For best results it is suggested that the elastic cable 18 first be cut three (3") inches short in order to provide the necessary stability for the binoculars 16.

Figure 5:
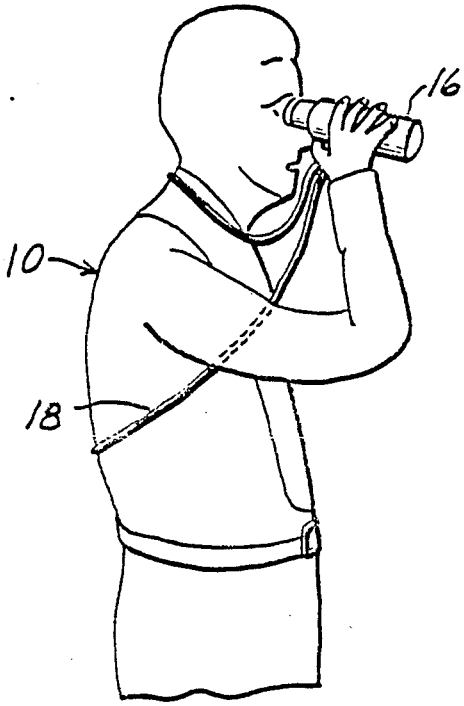
FIG. 5 is a perspective view of the hunter raising his binoculars to eye level with the present invention installed around his torso.

Referring specifically to FIG. 5, the hunter 10 may use his binoculars 16 effectively with the present invention installed by simply raising rhe binoculars 16 to eye level and stretching the elastic cable 18 in the process. The stretching of the elastic cable 18 not only allows the hunter 10 to use the binoculars 16 at eye level but also provides downward pressure on the binoculars 16 against the upward pressure of the hunter's arms. This downward pressure acts to stabilize the binoculars 16 at eye level when the hunter's arms are shaking as an after affect of running vigorously after his prey. Thus, the present invention both offers (1)a solution to the problem of binoculars swinging wildly around the hunter's neck, (2) the advantage of stabilizing the binoculars on the hunter's torso (3) relief of the hunter's neck fatigue by requiring some of the binocular's weight to be carried by the hunter's torso and the advantage of stabilizing the binoculars at eye level even with the shaking of the hunter's arms which occurs after vigorous running.

The preceding disclosure of the preferred embodiment of the present invention is for illustrative purposes only and shall not be considered as defining the scope of the present invention. Instead, the scope of the present invention shall be defined by the following claims and their equivalents.

I claim:

1. In connection with an article supported by the neck of its user and suspended about the user's body, a device for keeping the article secured to the user's body, comprising:

a length of elastic tubing;

means for interconnecting the elastic tubing at each end to the article including an elongated gripping piece having at least two ridges perpendicular to a longitudinal dimension of the gripping piece for gripping the elastic tubing when the gripping piece is installed within the elastic tubing; and means for securing each gripping piece to the article whereby;

the elastic tubing is adopted to be installed around the user and interconnected to the article.

2. The device in accordance with claim 1 in which the elastic tubing is surgical tubing.

3. The device in accordance with claim 1 in which the means for securing the gripping piece to the article is a wire ring placed through an area defining a hole in the gripping piece and an area defining a hole on the article.

4. The device in accordance with claim 1 further including means for quickly connecting and disconnecting the elastic cable from the article.

* * * * *